US007776500B2

(12) United States Patent
Molaire

(10) Patent No.: US 7,776,500 B2
(45) Date of Patent: Aug. 17, 2010

(54) MONOMERIC GLASS MIXTURES INCORPORATING TETRACARBONYLBISIMIDE GROUP

(75) Inventor: Michel F. Molaire, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 1098 days.

(21) Appl. No.: 11/453,407

(22) Filed: Jun. 15, 2006

(65) Prior Publication Data

US 2007/0292796 A1 Dec. 20, 2007

(51) Int. Cl.
*G03G 5/043* (2006.01)

(52) U.S. Cl. ..... 430/60; 430/56

(58) Field of Classification Search ..... 430/56, 430/60

See application file for complete search history.

(56) References Cited

U.S. PATENT DOCUMENTS

| | | | |
|---|---|---|---|
| 3,428,451 | A | 2/1969 | Trevoy |
| 4,082,551 | A | 4/1978 | Steklenski et al. |
| 4,971,873 | A | 11/1990 | Pavlisko et al. |
| 5,128,226 | A | 7/1992 | Hung |
| 5,681,677 | A | 10/1997 | Bugner et al. |
| 6,294,301 | B1 | 9/2001 | Sorriero et al. |
| 6,451,956 | B2 | 9/2002 | Sorriero et al. |
| 6,593,046 | B2 | 7/2003 | Sorriero et al. |
| 6,866,977 | B2 | 3/2005 | Sorriero et al. |

FOREIGN PATENT DOCUMENTS

| | | |
|---|---|---|
| JP | 2003-327587 | 11/2003 |
| JP | 2003-330209 | 11/2003 |

OTHER PUBLICATIONS

U.S. Appl. No. 10/888,172, filed Jul. 9, 2004, Molaire, et al.
U.S. Appl. No. 11/192,347, filed Jul. 28, 2005, Ferrar, et al.
U.S. Appl. No. 11/210,100, filed Aug. 19, 2005, Molaire, et al.

*Primary Examiner*—Mark F Huff
*Assistant Examiner*—Peter L Vajda
(74) *Attorney, Agent, or Firm*—Carl F. Ruoff; Andrew J. Anderson

(57) ABSTRACT

The present invention is a photoconductive element that includes an electrically conductive support, an electrical barrier layer disposed over said electrically conductive support, and disposed over said barrier layer, a charge generation layer capable of generating positive charge carriers when exposed to actinic radiation. The barrier layer includes a monomeric glass mixture incorporating tetracarbonylbisimide groups.

4 Claims, No Drawings

MONOMERIC GLASS MIXTURES INCORPORATING TETRACARBONYLBISIMIDE GROUP

CROSS-REFERENCE TO RELATED APPLICATIONS

This application relates to commonly assigned U.S. Pat. No. 7,579,127, filed simultaneously herewith and hereby incorporated by reference for all that it discloses.

FIELD OF THE INVENTION

This invention relates to electrophotography. More particularly, it relates to monomeric glass mixtures incorporating tetracarbonylbisimide groups and to photoconductive elements that contain an electrical charge barrier layer comprised of said monomeric glass mixtures.

BACKGROUND OF THE INVENTION

Photoconductive elements useful, for example, in electrophotographic copiers and printers are composed of a conducting support having a photoconductive layer that is insulating in the dark but becomes conductive upon exposure to actinic radiation. To form images, the surface of the element is electrostatically and uniformly charged in the dark and then exposed to a pattern of actinic radiation. In areas where the photoconductive layer is irradiated, mobile charge carriers are generated which migrate to the surface and dissipate the surface charge. This leaves in non-irradiated areas a charge pattern known as a latent electrostatic image. The latent image can be developed, either on the surface on which it is formed or on another surface to which it is transferred, by application of a liquid or dry developer containing finely divided charged toner particles.

Photoconductive elements can comprise single or multiple active layers. Those with multiple active layers (also called multi-active elements) have at least one charge-generation layer and at least one n-type or p-type charge-transport layer. Under actinic radiation, the charge-generation layer generates mobile charge carriers and the charge-transport layer facilitates migration of the charge carriers to the surface of the element, where they dissipate the uniform electrostatic charge and form the latent electrostatic image.

Also useful in photoconductive elements are charge barrier layers, which are formed between the conductive layer and the charge generation layer to restrict undesired injection of charge carriers from the conductive layer. Various polymers are known for use in barrier layers of photoconductive elements. For example, Hung, U.S. Pat. No. 5,128,226 discloses a photoconductor element having an n-type charge transport layer and a barrier layer, the latter comprising a particular vinyl copolymer. Steklenski, et al. U.S. Pat. No. 4,082,551, refers to Trevoy U.S. Pat. No. 3,428,451, as disclosing a two-layer system that includes cellulose nitrate as an electrical barrier. Bugner et al. U.S. Pat. No. 5,681,677, discloses photoconductive elements having a barrier layer comprising certain polyester ionomers. Pavlisko et al, U.S. Pat. No. 4,971,873, discloses solvent-soluble polyimides as polymeric binders for photoconductor element layers, including charge transport layers and barrier layers.

Still further, a number of known barrier layer materials function satisfactorily only when coated in thin layers. As a consequence, irregularities in the coating surface, such as bumps or skips, can alter the electric field across the surface. This in turn can cause irregularities in the quality of images produced with the photoconductive element. One such image defect is caused by dielectric breakdowns due to film surface irregularities and/or non-uniform thickness. This defect is observed as toner density in areas where development should not occur, also known as breakdown.

The known barrier layer materials have certain drawbacks, especially when used with negatively charged elements having p-type charge transport layers. Such elements are referred to as p-type photoconductors. Thus, a negative surface charge on the photoconductive element requires the barrier material to provide a high-energy barrier to the injection of positive charges (also known as holes) and to transport electrons under an applied electric field. Many known barrier layer materials are not sufficiently resistant to the injection of positive charges from the conductive support of the photoconductive element. Also, for many known barrier materials the mechanism of charge transport is ionic. This property allows for a relatively thick barrier layer for previously known barrier materials, and provides acceptable electrical properties at moderate to high relative humidity (RH) levels. Ambient humidity affects the water content of the barrier material and, hence, its ionic charge transport mechanism. Thus, at low RH levels the ability to transport charge in such materials decreases and negatively impacts film electrical properties. A need exists for charge barrier materials that transport charge by electronic as well as ionic mechanisms so that films are not substantially affected by humidity changes.

Condensation polymers of polyester-co-imides, polyesterionomer-co-imides, and polyamide-co-imides are all addressed in:

1. Sorriero et al. in U.S. Pat. No. 6,294,301.
2. Sorriero et al. in U.S. Pat. No. 6,451,956.
3. Sorriero et al. in U.S. Pat. No. 6,593,046.
4. Sorriero et al. in U.S. Pat. No. 6,866,977.
5. Molaire et al. in U.S. patent application Ser. No. 10/888,172.

These polymers have as a repeating unit a planar, electron-deficient, tetracarbonylbisimide group that is in the polymer backbone. The polymers are either soluble in chlorinated solvents and chlorinated solvent-alcohol combinations, or they contain salts to achieve solubility in polar solvents. In all cases, care must be taken not to disrupt the layer with subsequent layers that are coated from solvents, as this may result in swelling of the electron transport layer, mixing with the layer, or dissolution of part or all of the polymer. Furthermore, salts can make the layer subject to unwanted ionic transport.

Japanese Kokai Tokkyo Koho 2003330209A to Canon includes polymerizable naphthalene bisimides among a number of polymerizable electron transport molecules. Some of the naphthalene bisimides contain acrylate functional groups, epoxy groups, and hydroxyl groups. The monomers are polymerized after they are coated onto an electrically conductive substrate. However this approach does not ensure the full incorporation of all of the monomers. Some of the functional groups would not react to form a film and could thus be extracted during the deposition of subsequent layers. This would result in a layer that was not the same composition as deposited before polymerization. Further, it would allow for the unwanted incorporation of the electron transport agent into the upper layers of the photoreceptor by contamination of the coating solutions. Thus the need remains for a well-characterized electron transport polymer that can be coated and crosslinked completely to produce a layer that will transport electrons between layers of a photoreceptor without contaminating subsequent layers.

Japanese Kokai Tokkyo Koho 2003327587A to Canon describes the synthesis of naphthalene bisimide acrylate polymers. The polymers were coated from solution onto "aluminum Mylar" and irradiated with an electron beam to harden the layer to form crack free films. Mobility measurements were made. The need exists to form an insoluble film from a polymer that can transport electrons and has active sites for crosslinking that result in a film that can be overcoated with subsequent layers to form a photoreceptor. The crosslinking should be done either thermally or with UV light.

Photoconductive elements typically are multi-layered structures wherein each layer, when it is coated or otherwise formed on a substrate, needs to have structural integrity and desirably a capacity to resist attack when a subsequent layer is coated on top of it or otherwise formed thereon. Such layers are typically solvent coated using a solution with a desired coating material dissolved or dispersed therein. This method requires that each layer of the element, as such layer is formed, should be capable of resisting attack by the coating solvent employed in the next coating step. A need exists for a negatively chargeable photoconductive element having a p-type photoconductor, and including an electrical barrier layer that can be coated from an aqueous or organic medium, that has good resistance to the injection of positive charges, can be sufficiently thick and uniform that minor surface irregularities do not substantially alter the field strength, and resists hole transport over a wide humidity range. Still further, a need exists for photoconductive elements wherein the barrier layer is substantially impervious to, or insoluble in, solvents used for coating other layers, e.g., charge generation layers, over the barrier layer.

Accordingly, a need exists for a negatively chargeable photoconductive element having a p-type photoconductor, and including an electrical barrier layer that can be coated from an aqueous or organic medium, that has good resistance to the injection of positive charges, can be sufficiently thick and uniform that minor surface irregularities do not substantially alter the field strength, and resists hole transport over a wide humidity range. Still further, a need exists for photoconductive elements wherein the barrier layer is substantially impervious to, or insoluble in, solvents used for coating other layers, e.g., charge generation layers, over the barrier layer.

U.S. patent application Ser. No. 11/210,100, filed Aug. 19, 2005 by Molaire, et al. and U.S. patent application Ser. No. 11/192,347, filed Jul. 28, 2005 by Ferrar, et al. disclose the use of bis-imide polyols and malonate-blocked isocyanate as crosslinkable materials. Those naphthalene-bisimide containing polymers are usually soluble in chlorinated solvents not green solvents such as alcohols, ketones and water.

PROBLEM TO BE SOLVED BY THE INVENTION

A need exists for bis-imide materials that are soluble in environmentally friendly solvents for use in electrophotographic applications, specially in negatively chargeable photoconductive element having a p-type photoconductor, and including an electrical barrier layer that can be coated from an aqueous or organic medium, that has good resistance to the injection of positive charges, can be sufficiently thick and uniform that minor surface irregularities do not substantially alter the field strength, and resists hole injection and transport over a wide humidity range. Still further, a need exists for photoconductive elements wherein the barrier layer is substantially impervious to, or insoluble in, solvents used for coating other layers, e.g., charge generation layers, over the barrier layer.

SUMMARY OF THE INVENTION

The present invention is a photoconductive element that includes an electrically conductive support, an electrical barrier layer disposed over said electrically conductive support, and disposed over said barrier layer, a charge generation layer capable of generating positive charge carriers when exposed to actinic radiation. The barrier layer includes a monomeric glass mixture incorporating tetracarbonylbisimide groups.

DETAILED DESCRIPTION OF THE INVENTION

The invention provides for monomeric glass mixtures incorporating bisimide with tertavalentaromatic groups that are easily soluble in environmentally friendly solvents, such as alcohol, ketone, water or combination thereof. These monomeric glass mixtures can be formulated into crosslinkable formulation for electrophotographic applications. In particular, these materials can be used to provide a negatively chargeable photoconductive element having a p-type photoconductor, and including an electrical barrier layer that has good resistance to the injection of positive charges, can be sufficiently thick and uniform that minor surface irregularities do not substantially alter the field strength, and resists hole transport over a wide humidity range. The barrier layer is prepared from a monomeric glass mixture having planar, electron-deficient, tetracarbonylbisimide groups and soluble in environmentally friendly solvents. The barrier layer material is rendered substantially impervious to, or insoluble in, solvents used for coating other layers, e.g., charge generation layers, over the barrier layer by using crosslinking reaction such as urethane, epoxy, phenolic, and other crosslinking chemistries.

The monomeric glasses of this invention are prepared according to the technique described in M. F. Molaire and Roger Johnson in "Organic Monomeric Glasses: A Novel Class of Materials," Journal Polymer Science, Part A, Polymer Chemistry, Vol. 27, 2569-2592 (1989). These materials are used and described in U.S. Pat. Nos. 4,416,890 and 4,499,165 "Binder-Mixtures for optical Recording Layers and Elements," by Molaire. Their melt viscosity properties are demonstrated in "Influence of melt viscosity on the Writing Sensitivity of Organic dye-Binder Optical-Disk Recording Media," M. F. Molaire, Applied Optics, Vol. 27 page 743, Feb. 15, 1988.

The monomeric glasses of this invention are homogeneous mixtures of at least two nonpolymeric, thermoplastic compounds, each compound in the mixture independently conforming to the structure:

$$(R^1Y^1)_p[(Z^1Y^2)_mR^2Y^3]_n Z^2Y^4R^3$$

wherein m is zero or one;

n is the number of recurring units in the compound, and is zero up to, but not including, an integer at which said compound starts to become a polymer;

p is an integer of from one to eight;

each $R^1$ and $R^3$ is independently a monovalent aliphatic or cycloaliphatic hydrocarbon group having 1 to 20 carbon atoms, an aromatic group or a multicyclic aromatic nucleus;

$R^2$, $Z^1$ and $Z^2$ each independently represent multivalent aliphatic or cycloaliphatic hydrocarbon groups having 1 to 20 carbon atoms or an aromatic group, where at least one of $R^2$, $Z^1$ and $Z^2$ is a tetracarbonyl aromatic group of the formula:

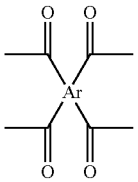

where

Ar=a tetravalent aromatic group having from 6 to 20 carbon atoms and may be the same or different. Representative groups include:

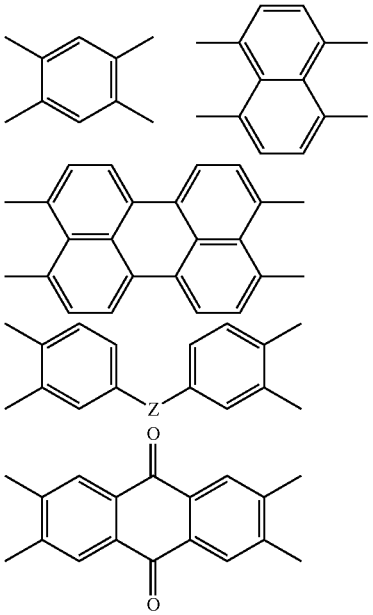

where Z =

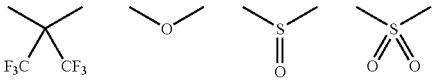

$Y^1$, $Y^2$, $Y^3$ and $Y^4$ each independently represents one or more linking groups such as esters (—COO—), amides (—CONH—), urethanes (—NHCOO—), imides

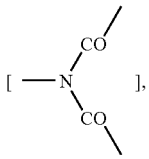

nitrilomethyleneoxys

-continued

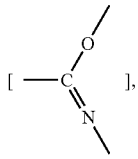

nitrilomethyleneiminos

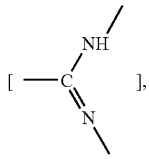

nitrilomethylenethios

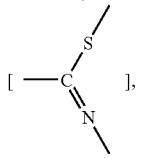

1,3,4-triazol-2,5-ylens

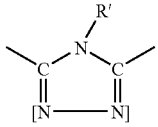

wherein R' represents alkyl of 1-6 carbon atoms, hydroxyl, amino or aryl such as phenyl and 1,3,4-oxadiazol-2,5-ylenes

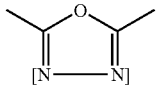

provided that at least on of $Y^1$ and $Y^2$, $Y^2$ and $Y^3$, or $Y^3$ and $Y^4$ are imide groups linking the tetra carbonyl aromatic group of the formula:

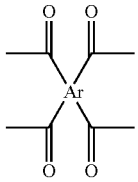

In the structural formula, the expression "$[(Z^1Y^2)_mR^2Y^3]_n$" describes nonpolymeric compounds which are oligomers. Oligomers are usually formed when either $Z^1$ or $R^2$ are at least bivalent. The $(Z^1Y^2)_m$ moiety describes oligomers in which $Z^1$ repeats itself such as when $Z^1$ is derived from p-hydroxybenzoic acid. When n is one or more, p in the structural formula is preferably one to avoid significant crosslinking of the compound due to the multivalent nature of $Z^1$.

Reacting either a mixture of bis-anhydrides incorporating the tetravalent aromatic groups above with an amino-alcohol, or a mixture of amino alcohols with a bis-anhydride, or reacting a mixture of amino-alcohols with a mixture of bis-anhydrides obtains the monomeric glass mixtures.

The more complex the mixture, the more difficult crystallization, the more soluble the resulting material. On the other hand it is preferable to keep the mixture as simple as possible to facilitate characterization, for quality control purpose. The more unsymmetrical the amino-alcohols, the more soluble the resulting glass mixtures. Examples of amino-alcohol include 2-amino-2-methyl-propanol, 1-amino-2propanol, 2(2-Aminoethoxy) Ethanol, 2-amino-1-butanol, 5-amino-1-pentanol, 4-aminophenol, 4-amino-m-cresol, ethanol amine, propanolamine, 5-amino-1-pentanol.

The preparation of such tetracarbonylbisimide is known and described, for example, in U.S. Pat. No. 5,266,429, the teachings of which are incorporated herein by reference in their entirety.

Monomeric diacid glass mixtures can be made by using amino-acid starting materials such as 10-amino-1-caboxylic acid, 3-amino-1-carboxylic acid.

The monomeric glass mixture incorporating tetravalent aromatic groups of this invention can be made using the same reaction procedure described in Sorriero et al. in U.S. Pat. No. 6,294,301.

2. Sorriero et al. in U.S. Pat. No. 6,451,956.
3. Sorriero et al. in U.S. Pat. No. 6,593,046.
Sorriero et al. in U.S. Pat. No. 6,866,977.

EXAMPLES

Example 1

Monomeric Glass Mixture of 1,4,5,8-Naphtalenetetracarboxilic Dianhydride

A mixture of 1,4,5,8-naphthalenetetracarboxylic dianhydride (80.37 g; 0.30 mole), 2-(2-aminoethoxy)ethanol (16.56 g; 0.1575 mole), 1-amino-2-propanol (11.83 g; 0.1575 mole), 2-amino-1-butanol (14.04 g; 0.1575 mole), 2-amino-2-methyl-1-propanol (14.04 g; 0.1575 mole) and 4-picoline (350 mL) was refluxed for 4 hr, cooled to room temperature and diluted with methanol (350 mL).

The mixture was very soluble, and very difficult to isolate.

The picoline solvent was neutralized with concentrated hydrochloric acid. An amorphous solid precipitated out. The solid was collected, dissolved in dichloromethane and reprecipitated into isopar G, filtered and collected.

The equation described in M. F. Molaire and Roger Johnson in "Organic Monomeric Glasses: A Novel Class of Materials," Journal Polymer Science, Part A, Polymer Chemistry, Vol. 27, 2569-2592 (1989), was used to calculate the expected composition of the mixture.

$$N(r=2)=\{n!/(2!(n-1)!\}S1+nS2$$

$$\text{Number of expected compounds in the mixture}=[4!/(2!(4-2)!]S1+4S2$$

Since S1 and S2=1

$$\text{Number of expected compounds in the mixture}=6+4=10$$

The isolated sample was submitted for HPLC analysis; the following compounds were identified,

| Compound | MW | Area Percent | R1 | R2 |
|---|---|---|---|---|
| 1 | 442 | 12.8 | 2-ethoxyethanol | 2-ethoxyethanol |
| 2 | 412 | 33.7 | 2-ethoxyethanol | 2-propanol |

-continued

| Compound | MW | Area Percent | R1 | R2 |
|---|---|---|---|---|
| 3 | 382 | 28 | 2-propanol | 2-propanol |
| 4 | 396 | 0.4 | 2-propanol | 1-butanol or 2-methyl--propanol |
| 5 | 426 | 3.1 | 2-ethoxyethanol | 1-butanol or 2-methyl--propanol |
| 6 | 396 | 9.1 | 2-propanol | 1-butanol or 2-methyl--propanol |
| 7 | 410 | 410 | 1-butanol or 2-methyl--propanol | 1-butanol or 2-methyl--propanol |

The average molecular wt of the glass mixture was estimated at 395.72. A hydroxyl equivalent wt of 276.5 was estimated for the mixture.

Example 2

Crosslinking of the Monomeric Glass Mixture of 1,4,5,8-Naphtalenecarboxyilic Dianhydride.

A sample of the monomeric glass mixture of example 1 (0.40 g) was mixed with 0.98 g of Trixene BI B7963 a Diethyl-malonate-blocked isocyanate obtained from Baxaden of Germany. The diol to malonate equivalence ratio was 1:1 1.1.2-trichloroethane (5 g) and 2-propanol (5 g) were used as solvent. Two drops each of DC510 surfactant, and dibutyl tin isopropoxide catalyst were added. The solution was hand coated on Estar film and dried on the coating block. The coated film was cured in a blue M oven 1t 150 C for 2 and 3 hours. Both samples were immersed in 1,1,2-TCE to test for crosslinking and insolubilization. Both samples remained untouched by the solvent.

The invention has been described in detail with particular reference to certain preferred embodiments thereof, but it will be understood that variations and modifications can be effected within the spirit and scope of the invention.

The invention claimed is:

1. A photoconductive element comprising an electrically conductive support, an electrical barrier layer disposed over said electrically conductive support, and disposed over said barrier layer, a charge generation layer capable of generating positive charge carriers when exposed to actinic radiation, said barrier layer comprising a crosslinked reaction product of a monomeric glass mixture of at least two nonpolymeric, thermoplastic compounds incorporating tetracarbonylbisimide groups, wherein the monomeric glass mixture has been rendered substantially impervious to solvents used for coating the charge generation layer over the barrier layer by using crosslinking reaction.

2. The photoconductive element of claim 1 wherein the monomeric glass mixtures comprises at least two nonpolymeric, thermoplastic compounds, each thermoplastic compound independently conforming to the structure:

$$(R^1Y^1)_p[(Z^1Y^2)_mR^2Y^3]_nZ^2Y^4R^3$$

wherein m is zero or one;

n is the number of recurring units in the compound, and is zero up to, but not including, an integer at which said compound starts to become a polymer;

p is an integer of from one to eight;

each $R^1$ and $R^3$ is independently a monovalent aliphatic or cycloaliphatic hydrocarbon group having 1 to 20 carbon atoms, an aromatic group or a multicyclic aromatic nucleus;

$R^2$, $Z^1$ and $Z^2$ each independently represent multivalent aliphatic or cycloaliphatic hydrocarbon groups having 1 to 20 carbon atoms or an aromatic group where at least one of $R^2$, $Z^1$ and $Z^2$ is a tetracarbonyl aromatic group of the formula:

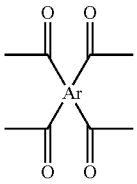

where Ar= a tetravalent aromatic group having from 6 to 20 carbon atoms and may be the same or different;

$Y^1$, $Y^2$, $Y^3$ and $Y^4$ each independently represents one or more linking groups such as esters (—COO—), amides (—CONH—), urethanes (—NHCOO—), imides

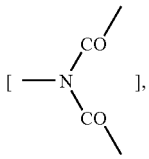

nitrilomethyleneoxys

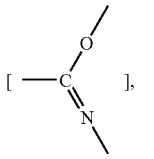

nitrilomethyleneiminos

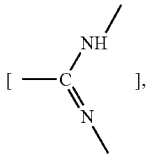

nitrilomethylenethios

-continued

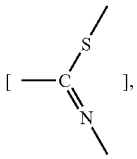

1,3,4-triazol-2,5-ylens

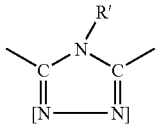

wherein R' represents alkyl of 1-6 carbon atoms, hydroxyl, amino or aryl such as phenyl and 1,3,4-oxadiazol-2,5-ylenes

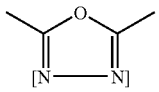

provided that at least one of $Y^1$ and $Y^2$, $Y^2$ and $Y^3$, or $Y^3$ and $Y^4$ are imide groups linking the tetra carbonyl aromatic group of the formula:

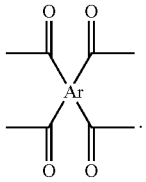

3. The photoconductive element of claim 2, wherein the crosslinking reaction employs urethane, epoxy, or phenolic crosslinking chemistry.

4. The photoconductive element of claim 1, wherein the crosslinking reaction employs urethane, epoxy, or phenolic crosslinking chemistry.

* * * * *